United States Patent [19]

Kerr

[11] Patent Number: 4,723,494

[45] Date of Patent: Feb. 9, 1988

[54] INCINERATOR DISCHARGE SYSTEMS

[75] Inventor: Clifford G. Kerr, Mississauga, Canada

[73] Assignee: Anclif Equities Inc., Streetsville, Canada

[21] Appl. No.: 2,684

[22] Filed: Jan. 12, 1987

[51] Int. Cl.[4] ..... F23G 5/00; F23G 5/12; F23G 5/44

[52] U.S. Cl. ..... 110/259; 110/165 R

[58] Field of Search ..... 110/259, 165, 168, 169, 110/210

[56] References Cited

U.S. PATENT DOCUMENTS

| | | | |
|---|---|---|---|
| 3,046,915 | 7/1962 | Ludin | 110/259 X |
| 3,855,950 | 12/1974 | Hughes, Jr. et al. | 110/165 R X |
| 4,279,222 | 7/1981 | Pearce | 110/165 R X |
| 4,619,210 | 10/1986 | Kennedy | 110/259 X |

FOREIGN PATENT DOCUMENTS

| | | | |
|---|---|---|---|
| 758046 | 10/1933 | France | 110/259 |

*Primary Examiner*—Edward G. Favors

*Attorney, Agent, or Firm*—Fetherstonhaugh & Co.

[57] ABSTRACT

A processor for processing the residue which is discharged from an incinerator comprises a receiver for receiving the residue and a discharge enclosure through which the residue is discharged from the receiver. The receiver has a secondary combustion chamber formed therein and an input passage opens into the secondary combustion chamber. A transfer passage communicates between the secondary combustion chamber and the discharge enclosure. A flow control device is located in the transfer passage and is operable to open or close the transfer passage to permit or prevent the flow of ash from the secondary combustion chamber to the discharge enclosure. An air blower is provided for the purposes of supplying combustion air to the secondary combustion chamber to encourage further combustion of the combustibles present in the residue. A conveyor is provided in the discharge enclosure for conveying the ash through the discharge enclosure.

8 Claims, 2 Drawing Figures

INCINERATOR DISCHARGE SYSTEMS

FIELD OF INVENTION

Figure 1:
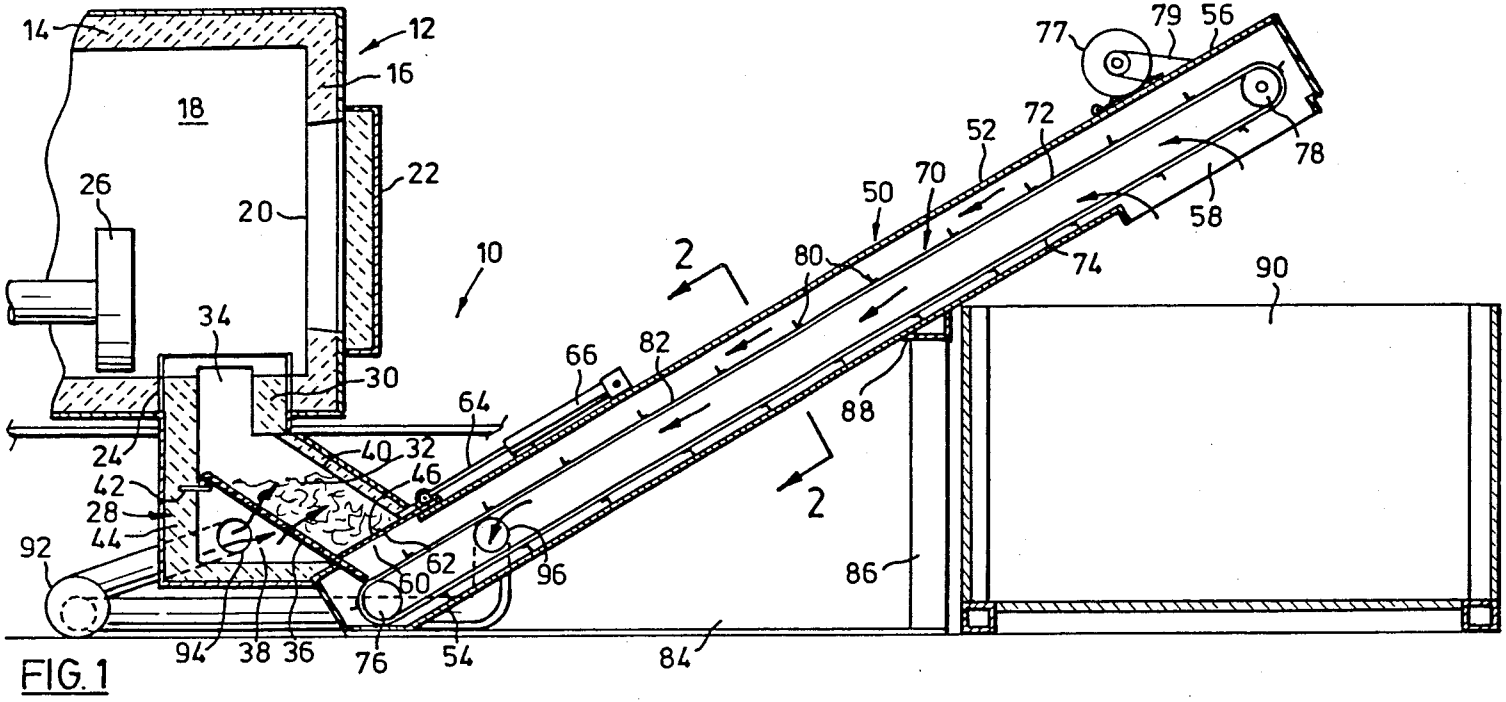

This invention relates to incinerators. In particular, this invention relates to a processor for processing the residue of an incinerator.

PRIOR ART

Incinerators which are used for the purposes of incinerating refuse such as domestic garbage or institutional or industrial waste frequently discharge a substantial proportion of combustible material in the residue. This is undesirable as it can lead to a condition where the residue contains materials and substances which are harmful to the environment when the residue is subsequently deposited at a land fill site or the like.

A further difficulty experienced in handling the discharge from an incinerator is that in order to maximize the efficiency of operation of the incinerator, it is desirable to discharge the residue as quickly as possible after combustion. As a result, the discharge is usually very hot when it is removed from the incinerator and this hot ash and residue is difficult to handle. Because there is usually some combustible material remaining in the hot discharge, there is a possibility of this combustible material bursting into flame, making the residue even more hazardous.

SUMMARY OF INVENTION

It is an object of the present invention to provide a simple and inexpensive processor for processing the residue which is discharged from an incinerator.

It is a further object of the present invention to provide a processor for processing the residue discharged from an incinerator which serves to provide a more complete combustion of the residue.

It is here another object of the present invention to provide a processor for processing the residue which is discharged from an incinerator which serves to cool the residue before it is discharged from the processor.

According to one aspect of the present invention, there is provided a processor for processing the residue which is discharged from an incinerator comprising a receiver having a secondary combustion chamber formed therein, an input passage opening into said secondary combustion chamber for admitting the residue to the secondary combustion chamber, a discharge enclosure having a proximal end and a distal end and a longitudinal extent extending between the proximal and distal ends, an output opening at the distal end of said discharge enclosure, a transfer passage communicating between said secondary combustion chamber and said proximal end of said discharge enclosure, flow control means at said transfer passage, said flow control means being movable between an open position and a closed position to permit or prevent the flow of ash from the second combustion chamber to the discharge enclosure, and means for supplying combustion air to said secondary combustion chamber to encourage further combustion of combustibles present in the residue present in the secondary combustion chamber in use.

According to a further aspect of the present invention there is provided an incinerator comprising an incinerator housing having a primary combustion chamber formed therein, said primary combustion chamber having a discharge opening through which the ash and the residue of combustion may be discharged, and means operable in said primary combustion chamber for directing said ash and residue to said discharge opening, a receiver having a secondary combustion chamber formed therein, an input passage opening into said secondary combustion chamber for admitting the residue to the secondary combustion chamber, a discharge enclosure having a proximal and distal ending between the proximal and distal ends, an output opening at the distal end of said discharge enclosure, a transfer passage communicating between said secondary combustion chamber and said proximal end of said discharge enclosure, flow control means at said transfer passage, said flow control means being movable between an open position and a closed position to permit or prevent the flow of ash from the second combustion chamber to the discharge enclosure, and means for supplying combustible to said secondary combustion chamber to encourage further combustion of combustibles present in the residue present in the secondary combustion chamber in use.

Figure 2:
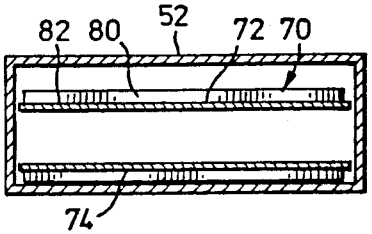

The invention will be more clearly understood after reference to the following detailed specification read in conjunction with the drawings wherein FIG. 1 is a sectional side view showing a processor mounted on an incinerator in accordance with an embodiment of the present invention;

FIG. 2 is a sectional view through the discharge enclosure taken along the line 2—2 of FIG. 1;

The reference numeral 10 refers generally to a processor constructed in accordance with an embodiment of the present invention. The processor 10 is used in association with an incinerator 12 which may be a batch incinerator of any conventional construction. A suitable incinerator is presently manufactured by Bio-Char Inc. of 7382 Winston Churchill Blvd., Mississauga, Ontario, L5N 3X7, and identified as Bio-Char Model 4, Pryolysis Solid Waste Incinerator.

The incinerator 12 has a cylindrical shaped side wall 14 and circular end walls 16 (only one of which is shown) within which a primary combustion chamber 18 is formed. An access opening 20 is formed in one of the end walls 16 and a door 22 is provided for use in opening and closing the access passage 20. An opening 24 is formed in the cylindrical wall 14 adjacent the end wall 16 in which the access passage 20 is formed. A ram 26 is provided for driving the combustion residue toward the opening 24.

A receiver generally identified by the reference numeral 28 has an upper end portion 30 arranged to fit in a close fitting relationship within the opening 24. In use, the upper end portion 30 is sealed in position with the aid of a refractory caulking material. The receiver 28 has a secondary combustion chamber 32 formed therein. An input passage 34 serves to communicate between the primary combustion chamber 18 and the secondary combustion chamber 32. The secondary combustion chamber 32 has a bottom wall 36 which is perforated. An air input compartment 38 is formed below the bottom wall 36. The bottom wall 36 is downwardly and forwardly inclined. The front wall 40 is similarly downwardly and forwardly inclined. All of the walls of the receiver are formed from a material such as a refractory material capable of accommodating combustion within the secondary combustion chamber 32. The upper edge of the bottom wall 36 is firmly anchored by means of suitable anchors 42 to the back wall 44 of the receiver 28.

A discharge enclosure generally identified by the reference numeral 50 is provided for receiving the ash which is discharged from the secondary combustion chamber 32 in use. The discharge enclosure consists of a longitudinally elongated duct 52 which has a proximal end 54 and a distal end 56. An output opening 58 is formed on the underside of the distal end. An input opening 60 is formed on the upper face of the duct 52 at the proximal end thereof. The input opening 60 communicates with the transfer passage 46 which is located at the lower end of the secondary combustion chamber 34. A flow control gate 62 is mounted on the reciprocating arm 64 of a cylinder 66 which may be pneumatically or hydraulically operated to cause the arm 64 to reciprocate between the extended position shown in FIG. 1 and the retracted position in which the gate 62 is withdrawn from the transfer passage 46.

As previously indicated, the discharge enclosure 50 includes a duct 52. The duct 52 is generally rectangular in cross section. A conveyor 70 is mounted in the duct 52 and has a forward run 72 and a return run 74. Support rollers 76 is located at the proximal end of the duct 52 and a support roller 78 is located at the distal end. The support roller 78 is drivingly connected to an electric motor 77 by means of a drive belt 79. The electric motor 77 can be activated and deactivated to move the conveyor belt either continuously or in a series of intermittent stages for the purposes of advancing the forward run of the conveyor belt. A plurality of pusher blades 80 project upwardly from the upper surface of the conveyor belt 80 at longitudinally spaced intervals along the length of the conveyor belt 80. The discharge enclosure is supported on a frame generally identified by the reference numeral 84 which includes an upright support 86 and a transverse support 88. The frame 84 serves to support the discharge enclosure in a position which it is upwardly inclined from the proximal end to the distal end so that the output opening 58 is elevated. This permits a receptacle such as a bin 90 to be located directly below the output opening so that the ash can be discharged directly into the bin 90 in use.

For the purposes of supplying combustion air to the secondary combustion chamber 32, a blower 92 is provided. The output of the blower is connected to a passage 94 which opens into the air input compartment 38.

In order to cool the ash which is discharged through the discharge enclosure, an air extraction passage 96 is formed in the wall of the duct 52 adjacent the proximal end thereof. The air extraction passage 96 is connected to the air inlet of the blower 92 to that the blower 92 acts as an extraction fan with respect to the discharge enclosure. As a result, the air is drawn into the duct 52 through the output opening 58 along the length of the duct to be extracted through the air extraction passage 96. During passage of the air along the duct 52, it serves to cool the ash which is located on the conveyor. The air passing through the duct 52 is therefore heated and is supplied to the blower 92 as preheated air. This preheated air is discharged by the blower 92 into the air input compartment 38 and passes through the bottom wall 36 to provide combustion air in the secondary combustion chamber 34.

In use, during the primary incineration process, the flow control gate 82 is located in the closed position and consequently, the transfer passage 46 is closed and the secondary combustion chamber is sealed with respect to the discharge enclosure. When the normal incineration process is completed in the incinerator, the pusher 26 may be activated to discharge the ash and the residue of combustion from the primary combustion chamber into the input passage 34. Simultaneously, the blower 92 is activated so that as the ash and residue fall into the secondary combustion chamber, the combustion air which passes through the bottom wall plate 36 will serve to establish an aerated fluidized bed which will serve to encourage further combustion of combustible materials present in the residue.

When secondary combustion has been completed, the flow control gate 62 is moved to the open position and the motor 77 is activated to drive the conveyor. As the forward run of the conveyor passage under the open lower end of the secondary combustion chamber, the ash which has accumulated in the secondary combustion chamber will fall onto the conveyor and will be transported upwardly along the conveyor by means of the pusher blades 80 until all of the ash which did accumulate in the secondary combustion chamber has been discharged onto the conveyor and is spread out along the length of the conveyor. Thereafter, the flow control gate 62 may be moved to the closed position and the ram 26 further activated to discharge a further quantity of residue into the secondary combustion chamber. It will be noted that when the blower 92 is reactivated to cause combustion air to enter the compartment 38, it will also act as an extraction fan causing cool air to be drawn from the output opening 58 through the discharge enclosure to the air extraction passage 96 and this will have the effect of cooling the ash which is located on the conveyor. Preferably, the conveyor 70 will remain stationary so that the ash will continue to be cooled during the time that the next batch of residue is being subjected to secondary combustion in the secondary combustion chamber. When the next batch is to be discharged, the roller 92 will be deactivated, the gate 62 moved to the open position and the conveyor 70 reactivated. The movement of the conveyor 70 will cuase the first batch of cooled ash to be discharged through the opening 58 into a receptable 90 while the second batch is being discharged onto the lower end of the forward run of the conveyor. This process can be repeated several times until all of the residue of the primary combustion has been removed from the primary combustion chamber 18.

Various modifications of the present invention will be apparent to those skilled in the art. For example, the gate 62 may be designed to pivot between an open and closed position. In addition, the discharge conveyor may be horizontally oriented or may have a portion of its length horizontally oriented.

The front wall 40 of the secondary combustion chamber 32 may be a removable wall which can be removed for the purposes of providing access to the secondary combustion chamber to facilitate the removal of incombustible aritcles which may become lodged in the secondary combustion chamber during use.

A typical receiver may have a secondary combustion chamber proportioned to accommodate 15 to 20 cubic feet of residue. A typical discharge enclosure may measure 15 to 20 feet in length and have a cross sectional area of 1.5 square feet.

I claim:

1. A processor for processing the residue which is discharged from an incinerator comprising (a) a receiver having a secondary combustion chamber formed therein, an input passage opening into said secondary combustion chamber for admitting the residue to the secondary combustion chamber, (b) a discharge enclosure having a proximal and distal and a longitudinal extent extending between the proximal and distal ends, an output opening at the distal end of said discharge enclosure, (c) a transfer passage communicating between said secondary combustion chamber and said proximal end of said discharge enclosure, (d) flow control means at said transfer passage, said flow control means being movable between an open position and a closed position to permit or prevent the flow of ash from the second combustion chamber to the discharge enclosure, (e) means for supplying combustion air to said secondary combustion chamber to encourage further combustion of combustibles present in the residue present in the secondary combustion chamber in use and (f) said discharge enclosure having an air extraction outlet located adjacent the proximal end thereof and means for withdrawing air through said air extraction outlet to draw air from the outlet opening of said enclosure along the length of the enclosure to cool ash as it travels along the discharge enclosure toward the output opening in use.

2. A processor as claimed in claim 1 wherein the means for supplying combustion air to the secondary combustion chamber functions as a means for withdrawing air through said air extraction outlet whereby the air which is heated as it cools the ash is supplied as preheated combustion air to the secondary combustion chamber.

3. A processor as claimed in claim 1 wherein the input passage of the receiver is arranged above the transfer passage and the secondary combustion chamber is angularly inclined downwardly from the input passage to the transfer passage to provide a gravity feed for ash passing through said secondary combustion chamber.

4. A processor as claimed in claim 3 wherein said secondary combustion chamber has a downwardly inclined bottom wall and wherein an air input compartment is formed below said bottom wall, said bottom wall being perforated to permit air to pass therethrough, said means for supplying combustion air comprising lower means arranged to supply air under pressure to said air input compartment from which it enters the secondary combustion chamber through said perforated bottom wall.

5. A processor as claimed in claim 1 further comprising conveyor means in said discharge enclosure for conveying ash from said proximal end to said distal end.

6. A processor as claimed in claim 5 wherein said discharge enclosure is upwardly inclined from the proximal end to the distal end so that the output end is elevated to facilitate discharge into a movable receptacle.

7. A processor as claimed in claim 1 wherein said flow control means comprises a gate which is pivotally mounted for movement between said open and closed positions.

8. A processor as claimed in claim 1 wherein said control means comprises a gate which is slidably mounted for movement between said open and closed positions.

* * * * *